US005609425A

United States Patent [19]

Kawano et al.

[11] Patent Number: 5,609,425

[45] Date of Patent: Mar. 11, 1997

[54] THERMAL SUBLIMATION PRINTER FOR USE WITH DIFFERENT RIBBONS

[75] Inventors: Junji Kawano; Hiroaki Fukuoka, both of Ise, Japan

[73] Assignee: Shinko Electric Co., Ltd., Chuo-Ku, Japan

[21] Appl. No.: 394,650

[22] Filed: Feb. 22, 1995

[30] Foreign Application Priority Data

Feb. 28, 1994 [JP] Japan ..... 6-030481

[51] Int. Cl.[6] ..... B41J 2/32

[52] U.S. Cl. ..... 400/120.01; 400/120.18; 347/172; 347/212

[58] Field of Search ..... 400/120.01, 120.03, 400/120.04, 120.14, 120.18; 347/171, 172, 175, 176, 178, 212

[56] References Cited

U.S. PATENT DOCUMENTS 4,666,320 5/1987 Kobayashi et al. ..... 400/241.1
4,704,615 11/1987 Tanaka ..... 400/240.3
4,815,872 3/1989 Nagashima ..... 400/240
5,220,343 6/1993 Takanashi et al. ..... 400/120.18
5,267,802 12/1993 Parnell et al. ..... 400/208
5,450,099 9/1995 Stephenson et al. ..... 400/82

*Primary Examiner*—John S. Hilten
*Attorney, Agent, or Firm*—Darby & Darby

[57] ABSTRACT

A thermal sublimation printer is disclosed. A pile of blank paper is inserted into a paper cassette 10, and a donor ribbon 21 coated with sublimation dyes is mounted on a supplying rotational axis 22 and a furl rotational axis 23 on bearings. The heating of a plurality of heating elements 4*a*, 4*a*, . . . , 4*a* of a thermal head 4, the movement of a platen roller 3, etc., are controlled by a control device as sublimation printing is carried out. The printed papers are then placed in the paper cassette 10, and exchanges the donor ribbon 21 for a fade preventive donor ribbon 27 coated with an over coating material. The over coating material is transferred on the printed paper by heat of the thermal head 4.

13 Claims, 3 Drawing Sheets

THERMAL SUBLIMATION PRINTER FOR USE WITH DIFFERENT RIBBONS

BACKGROUND OF THE INVENTION

1. Field of the Invention

The present invention relates to a thermal sublimation printer which is used for color printing by transferring sublimating dyes onto paper.

2. Background Art

FIG. 4 is a cross-sectional view showing a thermal transfer in a conventional thermal sublimation printer. In FIG. 4, a paper 1, to which is being transferred sublimating dyes, comprises a base material 1*a* and an image accepting layer 1*b*. A donor ribbon 2 comprises a dye layer 2*a*, an over coat material and a base material 2*b*. FIG. 5 is a plane view of the donor ribbon 2. In FIG. 5, the dye layer 2*a* of the donor ribbon 2 is separated into regions 2*c* coated with yellow dyes, regions 2*d* coated with magenta dyes, regions 2*e* coated with cyan dyes, and regions 2*f* coated with an over coat material. A control unit (not shown) of the thermal sublimation printer and sensor mark 2*g* are placed on the borders of the over coat material and regions 2*c*. Furthermore, the control unit (not shown) of the thermal sublimation printer and sensor marks 2*h*, 2*h*, . . . , are placed on each border of the regions 2*c*, 2*d*, 2*e*, and 2*f*.

A platen roller 3 and a thermal head 4 are showed in FIG. 4. A plurality of minute heating elements 4*a* are built in the thermal head 4. The paper 1 and the donor ribbon 2 contact each other to be pushed by the platen roller 3 and the thermal head 4. The paper 1 moves in the same direction (right or left, as shown) as the rotating direction of the platen roller 3. The donor ribbon 2 moves in direction Y by the action of a rotational axis (not shown). When the heating elements 4*a* of the thermal head 4 are heated, the dye layer 2*a* is also heated via the base material 2*b* of the donor ribbon 2. As a result, dyes of the dye layer 2*a*, which contact a heated point, melt and diffuse onto the image accepting layer 1*b* of the paper 1; the dyes then adhere to the surface of the paper 1. For example, when the region 2*c* of the donor ribbon 2 is placed under the heating elements 4*a*, yellow dyes adhere to the image accepting layer 1*b*.

The printing proceeds under the control of the control unit (not shown). In this printing process, while the regions 2*c*, 2*d*, and 2*e* are discriminated by the sensor marks 2*g* and 2*h*, the color printing proceeds in the order yellow, magenta, and cyan. Finally, the over coat material is fixed on the paper 1 from the region 2*f* to protect it from being affected by the atmosphere. The dyes, which are melted and diffused onto the image-accepting layer 1*b* of the paper 1, are resistant to temperature changes and acid atmospheres.

However, the conventional thermal sublimation printer has some problems. For example, the printer always coats the over coat material on the paper 1, so that wasteful over coating is performed in an area in which over coating is unnecessary. Therefore, the cost of the donor ribbon 2 or the cost of the power for the heating of the thermal head 4 is very high.

SUMMARY OF THE INVENTION

Accordingly, it is an object of the present invention to provide a thermal sublimation printer which is used in color printing by transferring sublimation dyes to a paper.

In an aspect of the present invention, there is provided a thermal sublimation printer, wherein the thermal sublimation printer carries out printing by transferring sublimating dyes by heating with a thermal head, the thermal sublimation printer comprising:

a dye donor ribbon, coated with sublimating dyes which are to be transferred onto an object to be printed, the sublimating dyes provided on a base material;

a fade-preventing donor ribbon coated with over coating material, which is to be coated on the object to be printed, the over coating material provided on a base material; and an exchanger for exchanging the dye donor ribbon for the fade-preventing donor ribbon, and vice versa.

According to the present invention, printing is carried out by the dye donor ribbon coated with sublimating dyes. When a over coating is to be carried out, the fade-preventing donor ribbon, coated with over coating material, is mounted in the printer, instead of the dye donor ribbon.

Therefore, in accordance with the present invention, it is possible to omit wasteful over coating when it is unnecessary, and to perform economical heat transfer because the unnecessary heating of the thermal head can be avoided. By identifying the kind of ribbon being used, i.e., the dye donor ribbon or the fade-preventing donor ribbon, the temperature of the thermal head can be controlled so as to control power consumption.

DETAILED DESCRIPTION OF THE PREFERRED EMBODIMENTS

Figure 1:
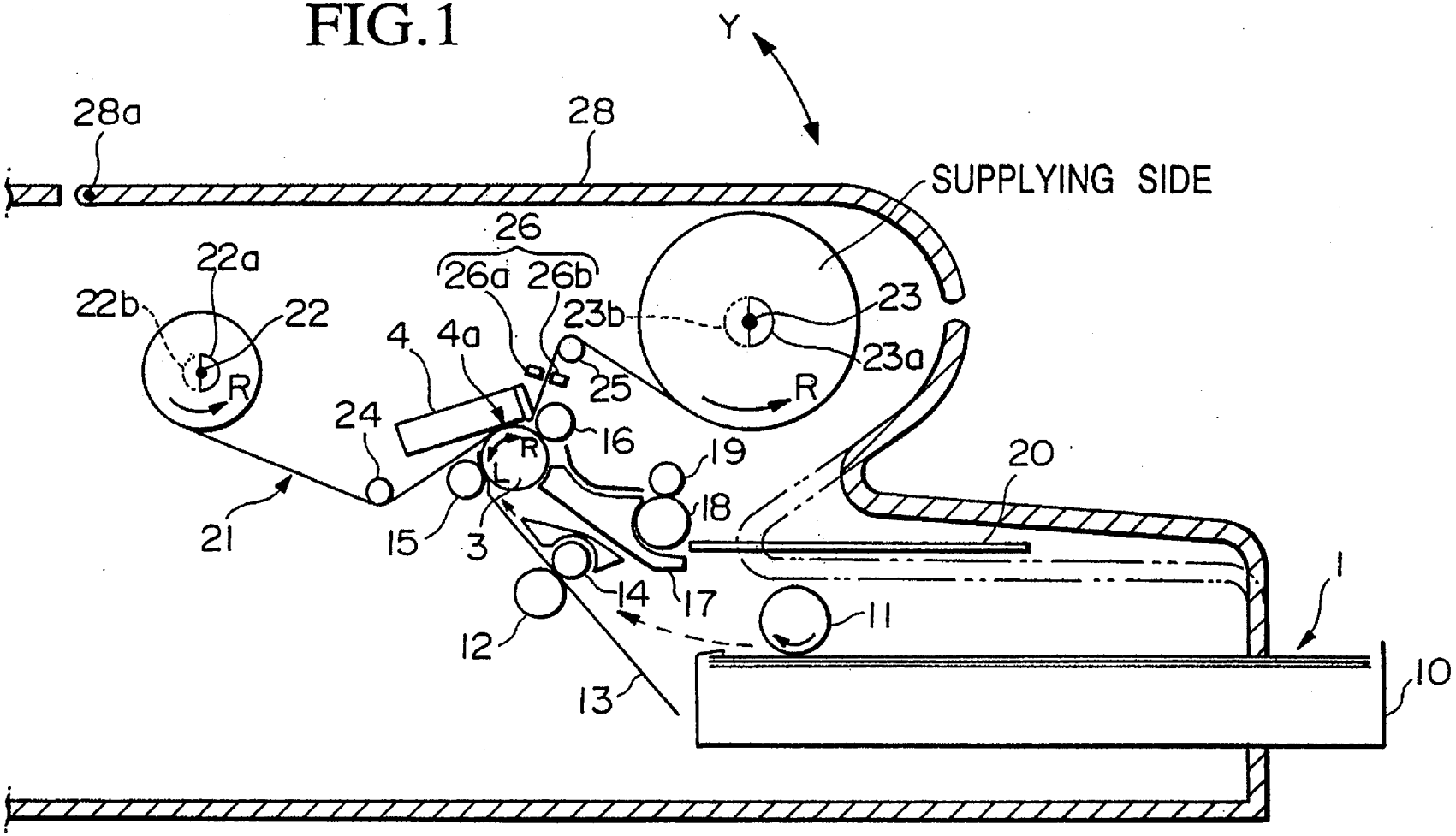
FIG. 1 is a side view of a thermal sublimation printer according to an embodiment of the present invention.
Figure 4:
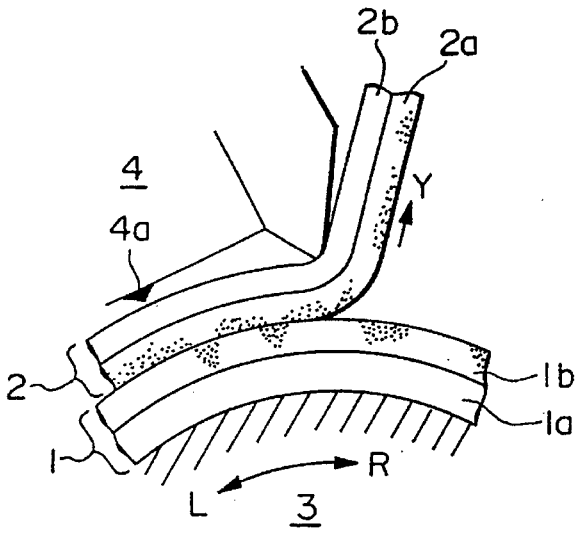
FIG. 4 is a side view showing a part of the thermal sublimation printer for describing the procedure of heating transfer.

FIG. 1 is a side view of a thermal sublimation printer according to an embodiment of the present invention. In FIG. 1, the same reference numbers are applied to several parts corresponding with FIG. 4, and the explanation of these parts will be omitted. In FIG. 1, a paper cassette 10 is mounted so as to be insertable into and removable from the thermal sublimation printer. A bale of papers to be printed is kept in the paper cassette 10. A paper feeding roller 11 is rotatably mounted at the upper left of the paper cassette 10, and is rotated by rotation of a motor (not shown). When the paper cassette 10 is inserted into the thermal sublimation printer, then the papers 1, 1, . . . , in the paper cassette 10 are forced upward, and the papers are urged toward the paper feeding roller 11 and make contact therewith.

Next, a paper transfer roller 12 is mounted at the left side of the paper feeding roller 11 and is rotated by rotation of a motor (not shown). A pinch roller 14 is rotatably mounted at the upper right side of the paper transfer roller 12, and makes contact therewith. A guide plate 13 guides a paper 1, which is fed by the paper feeding roller 11, between the paper transfer roller 12 and the roller 14, and also guides the paper 1 to the platen roller 3 which is mounted at the upper left side of the pinch roller 14.

Pinch rollers 15 and 16 are rotatably mounted at the lower left side and the upper right side, respectively, of the platen roller 3, and make contact therewith. A thermal head 4 is mounted at the upper left side of the platen roller 3, heating elements 4*a* of the thermal head 4 pushes and subsequently makes contact with the platen roller 3 via a donor ribbon 21. The paper 1, which is transferred along the guide plate 13 by the paper transfer roller 12, is pinched by the platen roller 3 and the pinch rollers 15 and 16 and moves in the same direction as the rotation of the platen roller 3.

Next, a paper transfer roller 18 is mounted at the lower right side of the platen roller 3, and is rotated by rotation of a motor (not shown). A pinch roller 19 is rotatably mounted at the upper side of the paper transfer roller 18, and makes contact therewith. A guide 17 is mounted to guide paper 1, which is transferred from the platen roller 3 between the rollers 18 and 19. A printed paper 1 is output to a tray 20 by rotation of the paper transfer roller 18.

A supplying rotational axis 22 is an axis in the center of the donor ribbon roll which is set at the supply side of the donor ribbon and is rotatably placed between two bearings 22*a* and 22*b* which are mounted at the left side of the thermal head 4 in such a manner that both ends of the supplying rotational axis 22 are fitted into the bearings 22*a* and 22*b*.

A furl rotational axis 23 is an axis placed in the center of the used donor ribbon, and is rotatably placed between two bearings 23*a* and 23*b* which are mounted at the right side of the thermal head 4, such that both ends of the furl rotational axis 23 are fitted into the bearings 23*a* and 23*b*. The bearings 22*a* and 22*b*, and 23*a* and 23*b*, are constructed so as to be able to be mounted or pulled out from the supplying rotational axis 22 or the furl rotational axis 23, so that it is possible to exchange the ribbons. Furthermore, the bearings 23*a* and 23*b* rotate in direction R with the rotation of a motor (not shown), and the used donor ribbon is furled onto the furled rotational axis 23 by the rotation of the bearings 23*a* and 23*b*.

There are two kinds of donor ribbon: a donor ribbon 21 coated with sublimation dyes and a donor ribbon 27 coated with an over coat which is used as a fade-preventing material; these ribbons are exchangeable in accordance with the requirements of the user.

Figure 2A:
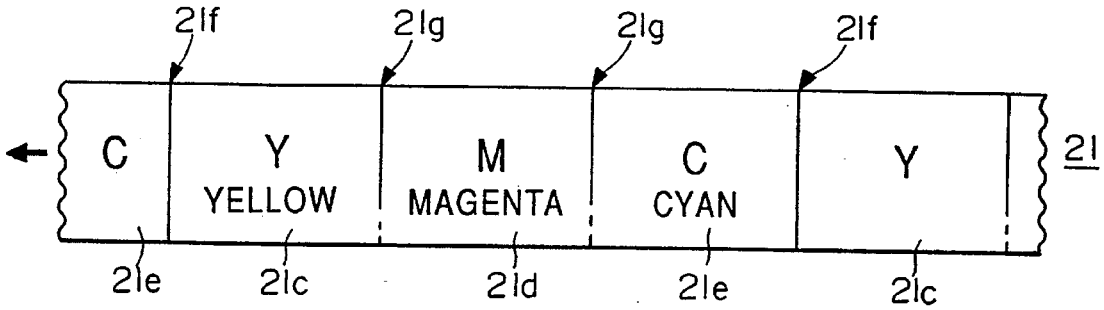
FIG. 2A is a plane view of a donor ribbon 21 which consists of sublimation dyes.
Figure 2B:
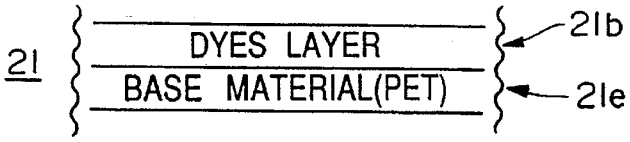
FIG. 2B is a cross-sectional view of the donor ribbon.
Figure 5:
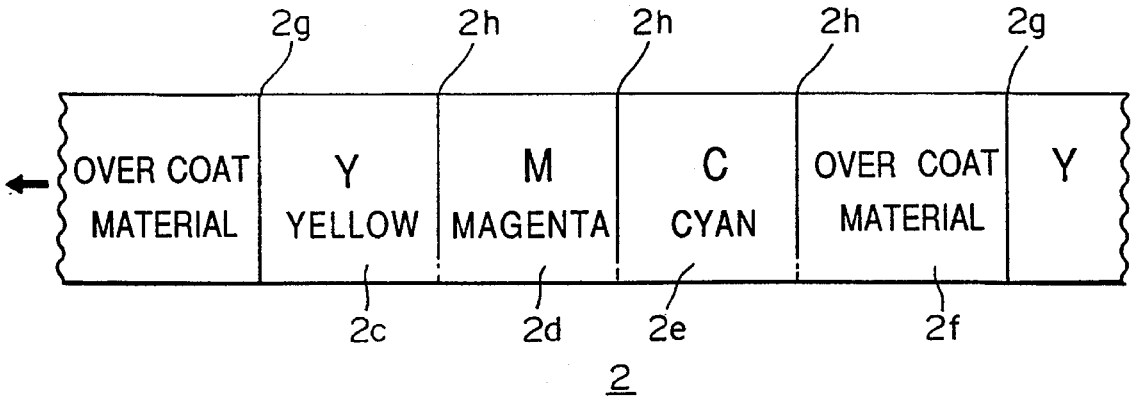
FIG. 5 is a plane view of a donor ribbon which consists of sublimation dyes in a conventional thermal sublimation printer.

FIG. 2 shows a donor ribbon 21. FIG. 2A is a plane view of the donor ribbon 21 on which is coated sublimating dyes, whereas FIG. 2B is a cross-sectional view of the donor ribbon 21. In FIG. 2A, the donor ribbon 21 does not have the region 2*f* of the over coat material shown in FIG. 5, and the donor ribbon 21 is separated into regions 21*c* coated with yellow dyes, regions 21*d* coated with magenta dyes, and regions 21*e* coated with cyan dyes. A sensor mark 21*g* is provided on a border of the regions 21*c* and 21*d*, or on a border of the regions 21*d* and 21*e*, whereas a sensor mark 21*f* is provided on a border of the regions 21*c* and 21*e*. These sensor marks 21*g* and 21*f* are formed with penetrating holes of different shapes. A sensor 26, shown in FIG. 1, detects and identifies the difference between the sensor marks 21*g* and 21*f*.

In FIG. 2B, base material 21*a* is formed of a plastic material. A sublimating dye layer 21*b* is formed by various kinds of sublimating dyes coated on the base material 21*a*.

Figure 3A:
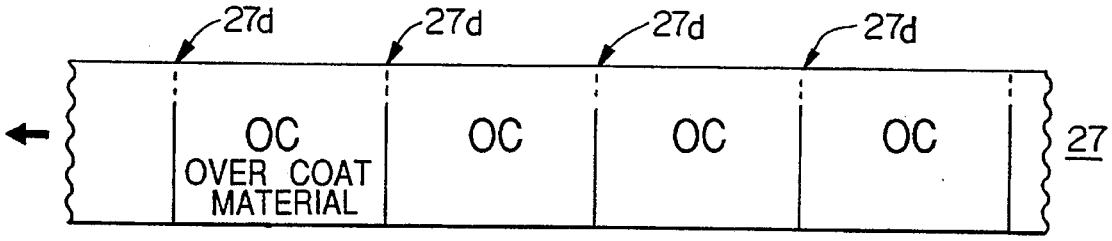
FIG. 3A is a plane view of a fade-preventing donor ribbon 27.
Figure 3B:
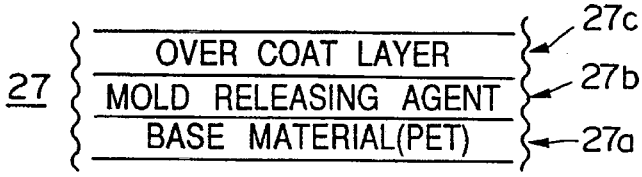
FIG. 3B is a cross-sectional view of the donor ribbon 27.

FIG. 3A is a plane view of a donor ribbon 27 for fade prevention, and FIG. 3B is a cross-sectional view of the donor ribbon 27. In FIG. 3A, a fade-preventing donor ribbon is divided into a plurality of regions by sensor marks 27*d*. The sensor marks 27*d* differ from the sensor marks 21*f* and 21*g*. In FIG. 3B, a base material 27*a* is formed by a plastic material. An over coat layer 27*c* is formed of PET, nylon, vinyl, or transparent resin etc., including glues. A releasing agent 27*b* is comprising a material which melts when heated. The releasing agent 27*b* normally fixes the base material 27*a* and the over coat layer 27*c*. However, when the mold releasing agent 27*b* is heated and melts, the over coat layer 27*c* separates from the base material 27*a*. The glues of the over coat layer 27*c* melt when heated, and glue the over coat layer 27*c* on a surface of the paper 1. The releasing agent 27*b* melts at a temperature which is lower than that of the printing process.

Next, in FIG. 1, a guide roller 24 is rotatably mounted at the left side of the pinch roller 15, and a guide roller 25 is rotatably mounted at the upper side of the pinch roller 16. These guide rollers 24 and 25 adjust the position of the donor ribbon 21 which passes through from the supplying rotational axis 22 to the furl rotational axis 23. An optical sensor 26 has an emission device 26*a* and a receiving device 26*b*, which are placed so as to sandwich the donor ribbon 21 which passes from the platen roller 3 to the guide roller 25. The optical sensor 26 detects sensor marks on the donor ribbon 27. A box cover 28 is generally closed, but is open along direction Y centered on rotational axis 28*a* when the donor ribbon 27 is exchanged for the donor ribbon 21.

The rotation of the above-mentioned motor is controlled by the control unit (not shown); so as to drive the paper feeding roller 11, the paper transfer rollers 12 and 18, the platen roller 3, the used donor ribbon 23, and the other rollers are driven by the motor.

Next, the performance of the thermal sublimation printer according to an embodiment will be described. First, the user opens the box cover 28. The user then sets the donor ribbon 21 by mounting the supplying rotational axis 22 and the furl rotational axis 23 to the bearings, respectively, so that the sublimating dye layer 21*b* (shown FIG. 2B) faces downward. The user then closes the box cover 28. Next, the user inserts a bale of unprinted paper into the paper cassette 10 so that the printing surface of the paper faces downward, and inserts the paper cassette 10 into the thermal sublimation printer. The thermal sublimation printer is then in operating condition.

In this condition, when print data, such as printing instructions or image information, is supplied from a host-computer (not shown), the furl rotational axis 23 is rotated in direction R until the sensor mark 21*f* (shown in FIG. 2A) is detected by the sensor 26. At the same time, the paper feeding roller 11, the paper transfer roller 12, and the platen roller 3 are rotated, and a paper 1 is transferred to the print starting position. The heat from the heating elements 4*a* is controlled on the basis of the image information, and the platen roller 3 and the furl rotational axis 23 are successively rotated In direction R. As a result, a yellow image is printed on the paper 1 in the region 21*c* of the donor ribbon 21.

When the printing of the yellow image is finished, the platen roller 3 rotates in direction L (the reverse of R), and returns the paper 1 to the print starting position. At the same time, the furl rotational axis 23 is rotated until the sensor mark 21*g* (shown in FIG. 2A) is detected by the sensor 26. At this time, a magenta image is printed.

Next, a cyan image is printed in the same manner. When all printing is finished, the printed paper 1 is output to the tray 20 by the paper transfer roller 18, and another paper 1 is then printed according to the above-described process.

It is possible to use the printed papers 1 as they are. However, so as to enhance preservation efficiency, over coating is carried out as follows. The user opens the box cover 28 and pulls out the rotational axes 22 and 23 from each bearing to dismount the dye donor ribbon 21 which was previously mounted. The user then so sets the fade-preventing donor ribbon 27 so that the over coat layer 27*c* of the donor ribbon 27 faces downward, and the user closes the box cover 28. The user has so arranged the pile of papers, already printed, in the paper cassette 10 so that the printing surface of the paper faces downward, and inserts the paper cassette 10 into the thermal sublimation printer.

In this condition, when print data, such as an over coating instruction, is supplied from a host-computer (not shown), the furl rotational axis 23 is rotated until the sensor mark 27*d* (FIG. 3A) is detected by the sensor 26. At the same time, a paper 1 is transferred to the print starting position in the same manner as that for performing printing. If the dye donor ribbon 21 is mounted in the printer, then this error is detected by the sensor 26 and no over coating is carried out.

When the over coating of the paper 1 is finished, paper 1 is next transferred to the print starting position, and the furl rotational axis 23 is rotated until the sensor mark 27*d* is detected by the sensor 26, and the over coating is then carried out. Another paper 1 is also over coated in accordance with the above-mentioned performance.

In the above-mentioned embodiment, although the instruction for the over coating is supplied from the host computer, the instruction may instead be output by an operating switch (not shown) which is installed on the printer body.

What is claimed is:

1. A thermal sublimation printer for printing on a printing object comprising:

a dye donor ribbon having a base material and sublimation dyes coating the base material;

a thermal head for heating the dye donor ribbon and transferring the sublimation dyes onto the printing object;

a fade preventive donor ribbon separate from said dye donor ribbon having a base material and an over-coating material coating the base material to coat the sublimation dyes transferred to the printing object by the heating of the dye donor ribbon; and a single ribbon mounting means for selectively mounting only one of said dye donor ribbon and said fade preventive donor ribbon.

2. A thermal sublimation printer according to claim 1, wherein said thermal head is also used as a heat source for said fade preventative donor ribbon and further comprising:

an identification means for identifying the type of donor ribbon to be used in the printer; and a control means for controlling the temperature of said thermal head on the basis of the result of the identification of the type of donor ribbon.

3. A thermal sublimation printer according to claim 2, wherein said dye donor ribbon is coated with a plurality of repeating sequences of sections of different color dyes, said dye donor ribbon having a first sensor mark placed at each border of a sequence, and a second sensor mark for changing color at borders between said sections of different colors;

said fade preventive donor ribbon having a third sensor mark for adjusting the position thereof; and wherein said identification means identifies said first sensor mark, said second sensor mark, and said third sensor mark.

4. A thermal sublimation printer according to claim 2, wherein said fade prevention donor ribbon over-coating material comprises a transparent resin transferable from said base material by heat from said thermal head to be fixed on said printing object.

5. A thermal sublimation printer according to claim 1, wherein each of said donor ribbons has a rotational axis and said single ribbon mounting means includes exchange means comprising bearings in which the rotational axis of said dye donor ribbon and said fade preventive donor ribbon is alternately mounted.

6. A thermal sublimation printer for printing on a printing object by transferring sublimation dyes by heating a dye donor ribbon with a thermal head, said thermal sublimation printer comprising:

a dye donor ribbon having a base material and sublimation dyes coating the base material;

a fade preventive donor ribbon separate from said dye donor ribbon having a base material and an over-coating material coating the base material, and a single ribbon mounting means for selectively and exchangeably mounting one of said dye donor ribbon and said fade preventive donor ribbon mounted for said dye donor ribbon in accordance with a requirement of said thermal sublimation printer.

7. A thermal sublimation printer according to claim 6, wherein said dye donor ribbon and said fade preventive donor ribbon are rolls each having a rotational axis;

said single ribbon mounting means comprising bearings into which the rotational axis of said dye donor ribbon and said fade preventive donor ribbon is mounted.

8. A thermal sublimation printer according to claim 7, further comprising:

an instruction supplying means for supplying an instruction to apply an over-coating;

wherein in response to said instruction the over-coating is carried out.

9. A thermal sublimation printer according to claim 8, further comprising:

a detecting means for detecting whether a said fade preventive donor ribbon is mounted in said bearings; and wherein in response to said instruction supplied from said instruction supplying means the over-coating is carried out when said detecting means detects said fade preventive donor ribbon mounted in said bearings.

10. A method of thermal sublimation printing onto an object by a thermal sublimation printer comprising the steps of:

providing in the printer a single ribbon mounting means;

mounting on said single ribbon mounting means a dye donor ribbon having sublimation dyes of different colors that are released onto the object upon heating of the ribbon;

printing indicia on an area of the object by subjecting the dye donor ribbon to heat;

removing said sublimation dye donor ribbon from said single ribbon mounting means;

thereafter mounting on said single ribbon mounting means a separate donor ribbon of a fade prevention material that is released by heating; and over-coating at least a part of the area on which the indicia is printed by subjecting the donor ribbon of fade prevention material to heat.

11. A method as in claim 10 further comprising the step of:

sensing the type of ribbon provided in the printer; and adjusting the quantity of heat provided in response to the type of ribbon sensed.

12. A method as in claim 10 further comprising the step of reinserting the object on which the printing takes place into the printer after having the sublimation dyes printed thereon to have the over-coating material placed thereon.

13. A method as in claim 10 wherein the heat for both the dye donor ribbon and the ribbon of over-coating material is supplied by a thermal head.

* * * * *